US005461676A

United States Patent [19]

Hobelsberger

[11] Patent Number: 5,461,676

[45] Date of Patent: Oct. 24, 1995

[54] DEVICE FOR IMPROVING BASS REPRODUCTION IN LOUDSPEAKER SYSTEM WITH CLOSED HOUSINGS

[76] Inventor: Maximilian H. Hobelsberger, Dorfstr. 16, Wuerenlingen CH-5303, Switzerland

[21] Appl. No.: 776,426

[22] PCT Filed: Mar. 15, 1991

[86] PCT No.: PCT/CH91/00060

§ 371 Date: Mar. 29, 1993

§ 102(e) Date: Mar. 29, 1993

[87] PCT Pub. No.: WO91/15933

PCT Pub. Date: Oct. 17, 1991

[30] Foreign Application Priority Data

Apr. 9, 1990 [CH] Switzerland ..... 1187/90
Jan. 7, 1991 [CH] Switzerland ..... 19/91

[51] Int. Cl.[6] ..... H04R 3/00
[52] U.S. Cl. ..... 381/96; 381/89; 381/159
[58] Field of Search ..... 381/96, 89, 159

[56] References Cited

U.S. PATENT DOCUMENTS 3,867,996 2/1975 Lou .
4,008,374 2/1977 Tiefenbrun .

FOREIGN PATENT DOCUMENTS 2405608 10/1977 France .
2637414 8/1976 Germany .
2122051 1/1984 United Kingdom .

*Primary Examiner*—Curtis Kuntz
*Assistant Examiner*—Ping W. Lee

[57] ABSTRACT

The devices proposed improve low-frequency sound reproduction in loudspeaker systems using acoustically closed loudspeaker housings. In particular, the devices permit the use of loudspeaker housings with very much smaller dimensional volumes but with large-area loudspeakers. The devices proposed operate utilizing pressure control in closed loudspeaker housings. This pressure control decreases differences between the gas pressure in the interior of the housing and the time-averaged mean gas pressure outside the housing. The control circuit comprises a pressure sensor, a control unit, a power amplifier and an electrodynamic transducer.

5 Claims, 3 Drawing Sheets

DEVICE FOR IMPROVING BASS REPRODUCTION IN LOUDSPEAKER SYSTEM WITH CLOSED HOUSINGS

BACKGROUND OF THE INVENTION

1. Field of the Invention

This invention relates to sound reproduction systems with electrodynamic loudspeakers and closed housings. More particularly, the invention relates to a sound reproduction system for improved bass reproduction.

2. Prior Art

Conventional loudspeaker systems have an inferior bass reproduction if the housings are small. In small housings air compression forces will build up and hinder the movement of the radiating loudspeaker's membrane. These forces evolve from volume changes in the air inside the housing which are caused by the movement of the loudspeaker's membrane. The membrane compresses or decompresses the air and the resulting forces hinder the movement of the membrane. Being elastic forces they also increase the resonance frequency of the system.

To achieve a satisfying bass reproduction large, impractical housings are used, or different kinds of resonant boxes are employed. Often the driving signals are corrected in their frequency characteristic, or the loudspeakers are controlled by servo systems. All these solutions cause distortions or are impractical to use, or show a poor pulse response.

Another known method (Tiefenbrun, U.S. Pat. No. 4,008,374) uses a second loudspeaker incorporated into the housing to simulate a larger volume. However this method just transfers the problems from the outer to the inner loudspeaker. To achieve satisfying results large housings must be used once again. Additionally, problems arise from distortions caused by phase differences between the movements of the membranes'.

Price Shelton's invention (Goodman, appl. GB.821 5906) follows Tiefenbrun's principle of using an inner transducer to simulate a larger inner volume. In addition Shelton places a pressure sensor into the inner chamber of the housing to measure pressure changes. The signal produced by the sensor is amplified by an operational amplifier and drives the inner transducer. Optionally a feedback circuit can be inserted into the signal path between the sensor and the amplifier.

Sheltons disclosure fails to teach how the system should really work: In particular just conveying the signal produced by the sensor to the operational amplifier will result in oscillation of the system and distortions generated by the system. The function of the optional feedback circuit is not clearly defined either.

SUMMARY OF THE INVENTION

The inventions as defined by the claims improve the bass reproduction of loudspeaker systems with small housings and with large loudspeaker membranes. Neither a direct correction of the driving signals is used in the invented systems nor is a servo system for the radiating loudspeaker employed.

The above-mentioned results are achieved by the systems characterized by the claims. The invented systems are unique because of the fact that differences between the air pressure inside the housing and the time-averaged mean pressure outside the housing are almost eliminated by the use of a closed loop control system. The differences are measured by pressure sensors and the corresponding electrical signals are conveyed to a controller. The control system practically eliminates the differences. This reduction of pressure differences is achieved by the movement of the membrane of an electromechanical transducer inside the housing. The membrane adjoins the concerned air volume inside the housing. The transducer is incorporated into a closed loop control system. A controller receives the electrical signals produced by the pressure sensors. It calculates corresponding output signals, which are amplified by a power amplifier and which then drive the transducer. The signals are calculated in a way that the membrane of the transducer is forced to perform movements which eliminate the pressure differences.

For a fuller understanding of the nature of the invention, reference should be made to the following detailed description of the preferred embodiments of the invention, considered together with the accompanying drawings.

DESCRIPTION OF THE PREFERRED EMBODIMENTS

Figure 1:
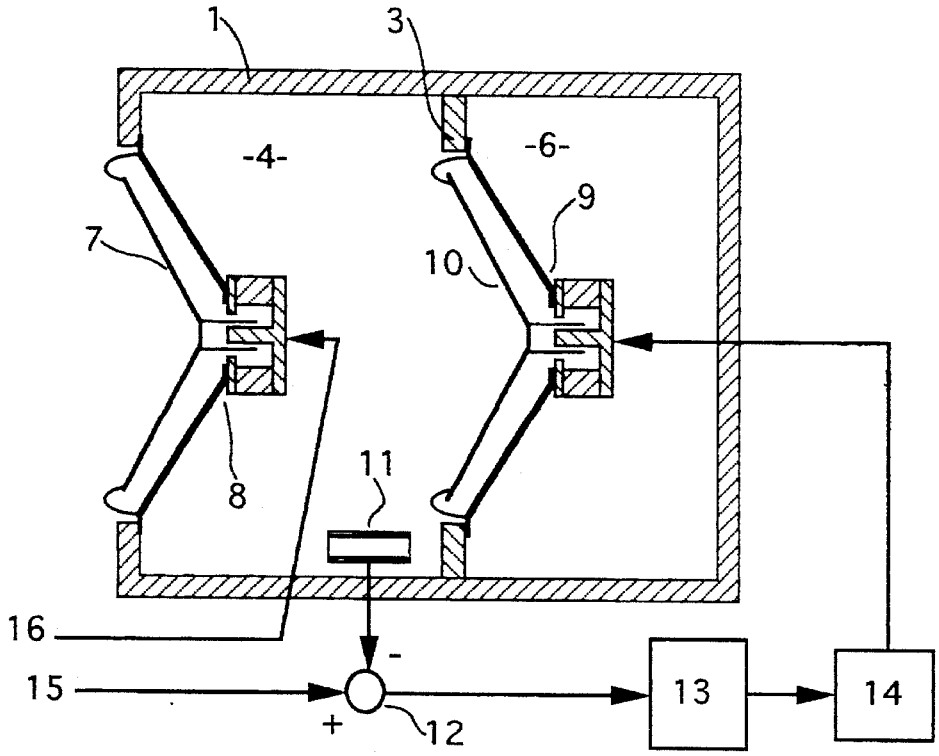
FIG. 1 is a schematic view of a speaker system that is a first embodiment of the present invention.

The following is a description of a first embodiment of the invention and refers to FIG. 1.

A loudspeaker 8 is built into an opening of the soundproof and pressure-tight housing 1 with its membrane 7 front facing outward. The loudspeaker 8 is directly driven by the audio signal 16. The loudspeaker housing 1 is divided into two chambers, 4, 6, by a soundproof and almost pressure-tight wall 3. The first chamber, 4, is enclosed by the membrane 7 of the sound radiating loudspeaker 8, by first parts of the walls of the housing and by the inner wall 3. The second chamber, 6, is enclosed by the inner wall 3 and second parts of the walls of the housing 1. An electrodynamic transducer 9 is built into an opening of the inner wall 3 so that its membrane 10 separates the chamber 4 from the chamber 6. A pressure sensor 11 is placed into the first chamber 4 which adjoins the membrane 7 of the sound radiating loudspeaker 8. The sensor produces a signal proportional to the pressure in this chamber. This signal is subtracted from a signal proportional to the mean air pressure outside the housing, 15, in a subtracting function block 12. The resulting signal is conveyed to the input of a servo controller 13. The subtracting function block 12 provides the inverting and the noninverting inputs of a standard control loop. It should be understood as a symbolic function block, to show the principle of operation. The subtraction could be performed in a sensor which already produces a signal proportional to the pressure difference. Or the controller itself could have two inputs.

The electrodynamic transducer 9 is one element of a closed loop control system. The other elements are the controller 13, the power amplifier 14 and the pressure sensor 11. The signal 15 which is proportional to the time-averaged air pressure outside the housing is applied as the setpoint value to the noninverting input of the subtracting function block 12 of the control system. The averaged time period should be long in comparison to the periods of the signal driving the loudspeaker 8, e.g. 100s. The output signal of the pressure sensor 11 inside the housing 1 is applied to the inverting input of the subtracting function block 12 of the control system. The output of the subtracting block is connected to the controller 13. The output of the controller 13 is connected to a power amplifier 14, which amplifies the signal and drives the transducer 9. The controller generates output signals to minimise the differences between the input signals and therefore also eliminates the pressure differences. This is achieved by appropriate movement of the membrane 10 of the transducer 9. The controller can be a PI—(i.e. proportional-integrating) controller, or a PID—(i.e. proportional-integrating-deriving) controller. Preferably a state-space controller is used. This type of controller controls the state variables of the system, i.e. the air pressure and its derivatives, and the position of the inner membrane and its derivatives.

Figure 2:
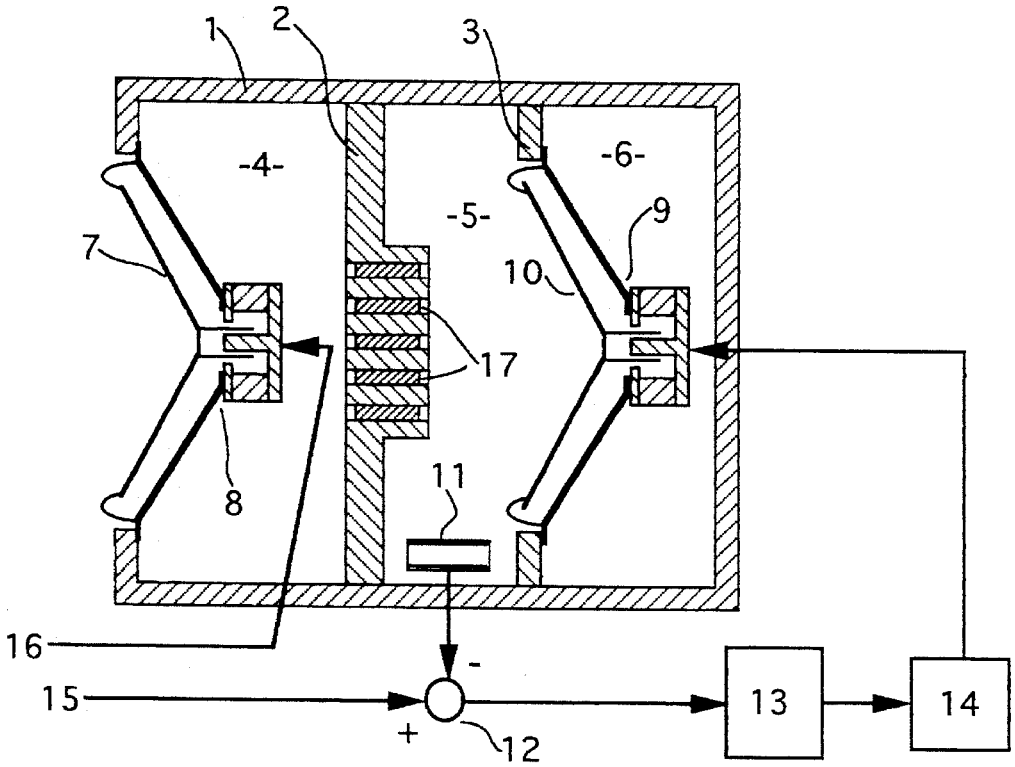
FIG. 2 shows a second embodiment of the invention.
Figure 3:
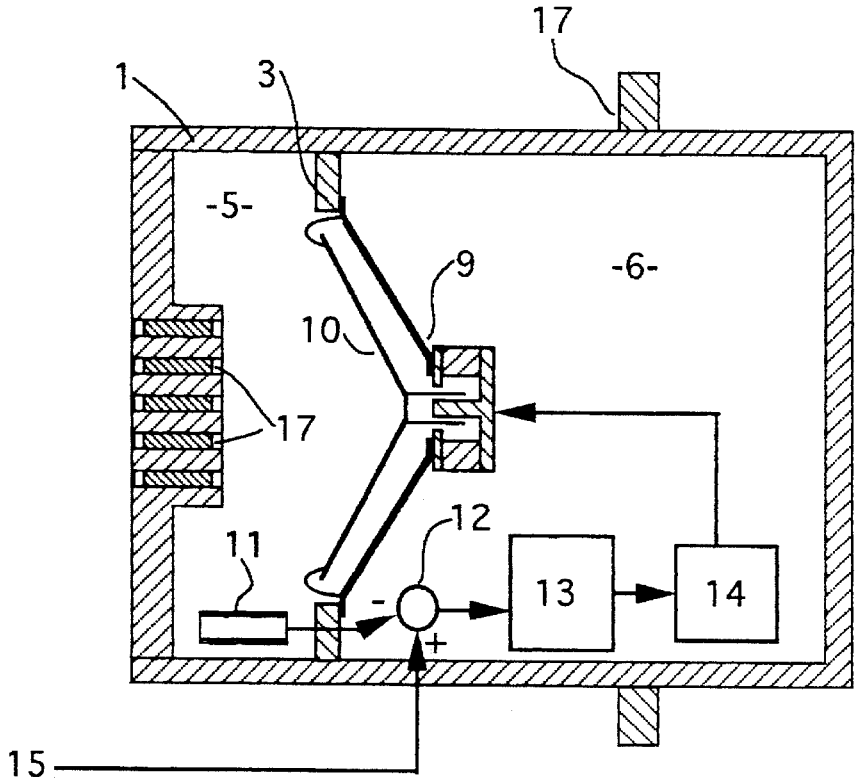
FIG. 3 shows a schematic view of a third embodiment of the invention.

The embodiments of the invention shown in FIG. 2 and FIG. 3 make possible an easy and unproblematic application of the principle of pressure control which increases the quality of bass reproduction. In particular the dimensions of the inner volume of the housing should be irrelevant for the performance of the closed loop control system. This would allow the production of a product which could be used and set into operation even by the inexperienced. The following embodiments will allow an optimal performance of the closed loop system which will be independent of the housing dimensions. This means the system will neither oscillate nor will it produce distortions due to the influence of high frequency signals.

FIG. 2 shows a second embodiment of the invention which provides the above described advantages.

It consists of a soundproof and pressure-tight housing 1. A loudspeaker 8 is built into an opening of the soundproof and pressure-tight housing 1 with its membrane 7 front facing outward. The loudspeaker 8 is directly driven by the audio signal 16. The loudspeaker housing 1 is divided into three chambers, 4, 5, 6, by two soundproof and almost pressure-tight inner walls, 2, 3. The first chamber, 4, is enclosed by the membrane 7 of the sound radiating loudspeaker 8, by first parts of the walls of the housing and by the first inner wall 2. The second chamber, 5, is enclosed by the first inner wall 2, by second parts of the walls of the housing 1 and by the second inner wall 3. The third chamber is enclosed by the second inner wall 3 and by third parts of the walls of the housing.

The first inner wall 2 has holes 17 which connect the first inner chamber 4 with the second inner chamber 5. An electrodynamic transducer 9 is built into an opening of the other inner wall 3 so that its membrane 10 separates the chamber 5 from the other chamber 6. A pressure sensor 11 is placed into the middle chamber 5. The sensor produces a signal proportional to the pressure in this chamber. This signal is subtracted from a setpoint value signal 15 proportional to the mean air pressure outside the housing, in a subtracting function block 12. The resulting signal is conveyed to the input of a servo controller 13 which drives the power amplifier 14. The subtracting function block 12 provides the inverting and the noninverting inputs of a standard control loop. It should be understood as a symbolic function block, to show the principle of operation. The subtraction could be performed in a sensor which already produces a signal proportional to the pressure difference. Or the controller itself could have two inputs. The output of the power amplifier 13 is connected to the electrodynamic transducer 9 to drive the membrane 10 of this transducer. The third chamber, 6, prohibits influences by the inner membrane's movements on the outside of the housing.

The above described advantages concerning the control system are achieved by giving the pressure controlled volume well-defined and small dimensions at high frequencies. In addition, this volume is protected from influences by high frequency signals which are produced by the outer, radiating loudspeaker. These high frequency signals would otherwise force the control system to produce the distortions.

Both aims are achieved by the above described embodiment according to FIG. 2.

The controlled system is the small volume in the middle chamber 5 inside the housing. This chamber is separated from the chamber 4 by the soundproof wall 2.

The inner wall 2 has holes 17 by which the chamber 4 and the chamber 5 connect. These holes are constructed and stuffed with sound absorbing materials that sound and pressure are transferred between both volumes according to a transfer function with low pass characteristics.

The pressure sensor 11 measures the air pressure in the inner chamber 5.

The closed loop control system, consisting of the controller 13, the power amplifier 14, the transducer 9 and the sensor 11 keeps the difference between the air pressure in the middle chamber 5 and the averaged air pressure outside the housing very low. This is achieved by appropriate movements of the transducer's membrane 10.

The third pressure-tight chamber 6 prohibits influences by the movements of the transducer's membrane on the outside of the housing.

Because slow pressure changes are transferred by the low pass filter, slow changes of the pressure in the first inner chamber, 4, which are caused by the movement of the loudspeaker's membrane 7 are suppressed too.

However, fast changes of pressure in the middle chamber 5 caused by the control system affect only the well-defined volume of the chamber 5. Thus dead time and delay which may cause oscillations, can be compensated by corresponding adjustment of the controller.

Additionally, high frequency signals generated by the loudspeaker 8 will not be transferred to the chamber 5 and therefore cannot influence the control system.

Thus the device enables an almost undistorted reproduction of low frequencies by eliminating the low frequency compression forces.

The embodiment shown in FIG. 3 allows an easy application of the principle of pressure control even by the inexperienced. The device is one entity which contains all the necessary elements. It can be bought and simply installed into a closed loudspeaker housing like a normal loudspeaker to build a device functioning like that of FIG. 2. The closed loop control system is already adjusted optimally.

The device has a cylindrical, acoustically closed and almost pressure-tight housing 1. The housing is in the shape of a cylinder closed by lids at each end. The inner volume of the device is divided by a soundproof and almost pressure tight wall 3 into two chambers 5, 6. An electrodynamic transducer 9 is built into an opening of the inner wall and separates with its membrane 10 separates the two inner chambers. A pressure sensor 11 is placed into the first chamber 5. It produces a signal indicative of the pressure in this chamber. This sensor is part of a closed loop automatic control system, which comprises, in addition, the transducer 9, an electronic controller 13 and an electronic power amplifier 14. The output signal of the sensor is subtracted by the subtracting function block 12 from a signal 15 which is proportional to the averaged air pressure outside the housing. The subtracting function block 12 provides the inverting and the noninverting inputs of a standard control loop. It should be understood as a symbolic function block, to show the principle of operation. The subtraction could be performed in a sensor which already produces a signal proportional to the pressure difference. Or the controller itself could have two inputs. In terms of control theory the signal 15 is the setpoint value, the sensor's output signal is the controlled variable.

The resulting signal is conveyed to the input of a servo controller 13 which drives the power amplifier 14. The output of the power amplifier 14 is connected to the inner electrodynamic transducer 9 to drive the membrane 10 of this transducer.

The controller and the other components are dimensioned in such a way that the pressure difference between the momentary air pressure in the first chamber 5 and the time-averaged mean air pressure outside the enclosure is always held very small by the control system.

One of the housing's lids which adjoins the chamber 5 is equipped with holes 17 which connect the chamber 5 with the outside of the housing. These holes are constructed and stuffed with a fibrous or foamy, acoustically damping material that sound and pressure are transferred between the chamber 5 and the outside according to a transfer function with low pass characteristic. The housing has a circular fold 17 around its body to allow a sound-proof mounting of the device into an opening of a closed loudspeaker housing. By mounting this device into a closed loudspeaker housing with the holes opening to the inside of the housing a device similar to the embodiment of FIG. 2 is easily created.

Figure 4:
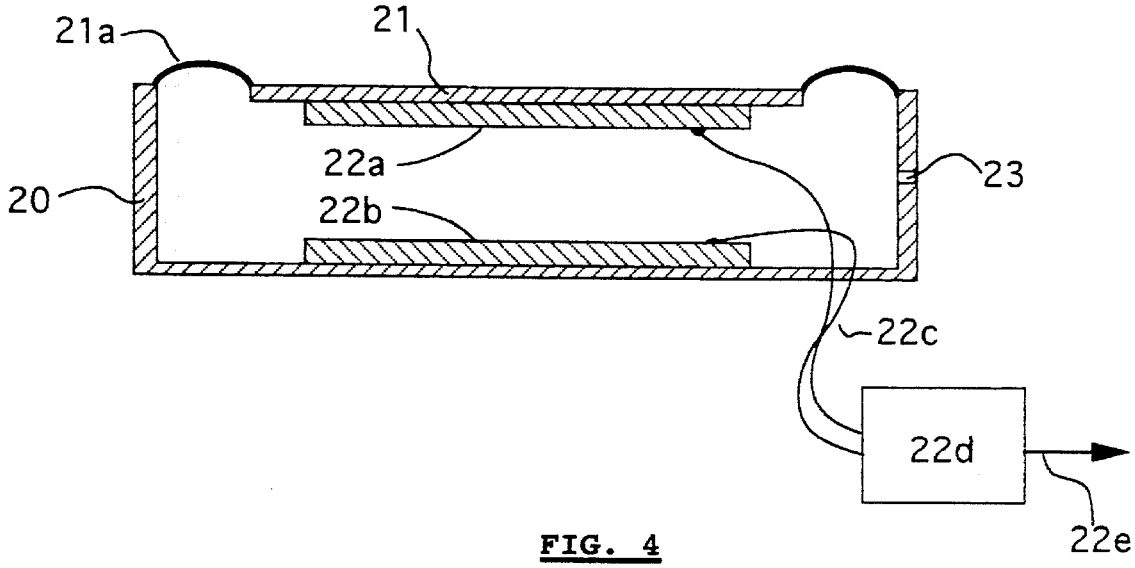
FIG. 4 shows a pressure sensor used in the invention.

FIG. 4 shows a preferred pressure sensor which allows a direct measurement of the difference between the air pressure, which should be controlled, and the time-averaged, mean air pressure outside the loudspeaker housing.

It consists of a closed, pressure-tight housing 20 with a displaceable lid 21. The lid is connected to the housing by flexible, pressure tight material 21*a* which acts additionally as a spring. The volume inside the housing connects to the outside of the housing via a narrow hole 23. This hole permits only a slow air exchange between the inside and the outside. Therefore, the mean air pressure inside the housing equals the mean air pressure outside the housing.

The pressure difference between the inside and the outside causes the lid to move a proportional distance which is measured by measuring means. This measurement can be done by e.g. capacitive, inductive, or resistive means.

FIG. 4 shows a capacitive method using two conductive layers 22*a*, 22*b* which form as condenser and which are connected to a measuring circuit 22*d* by wires 22*c*. The capacitance of this condenser is measured by the circuit 22*d* and an electrical signal 22*e* proportional to the changes of the capacitance is generated. The resulting electrical signal can be directly applied to the controllers input. An additional filter may be used to remove DC components from the signal.

Figure 5:
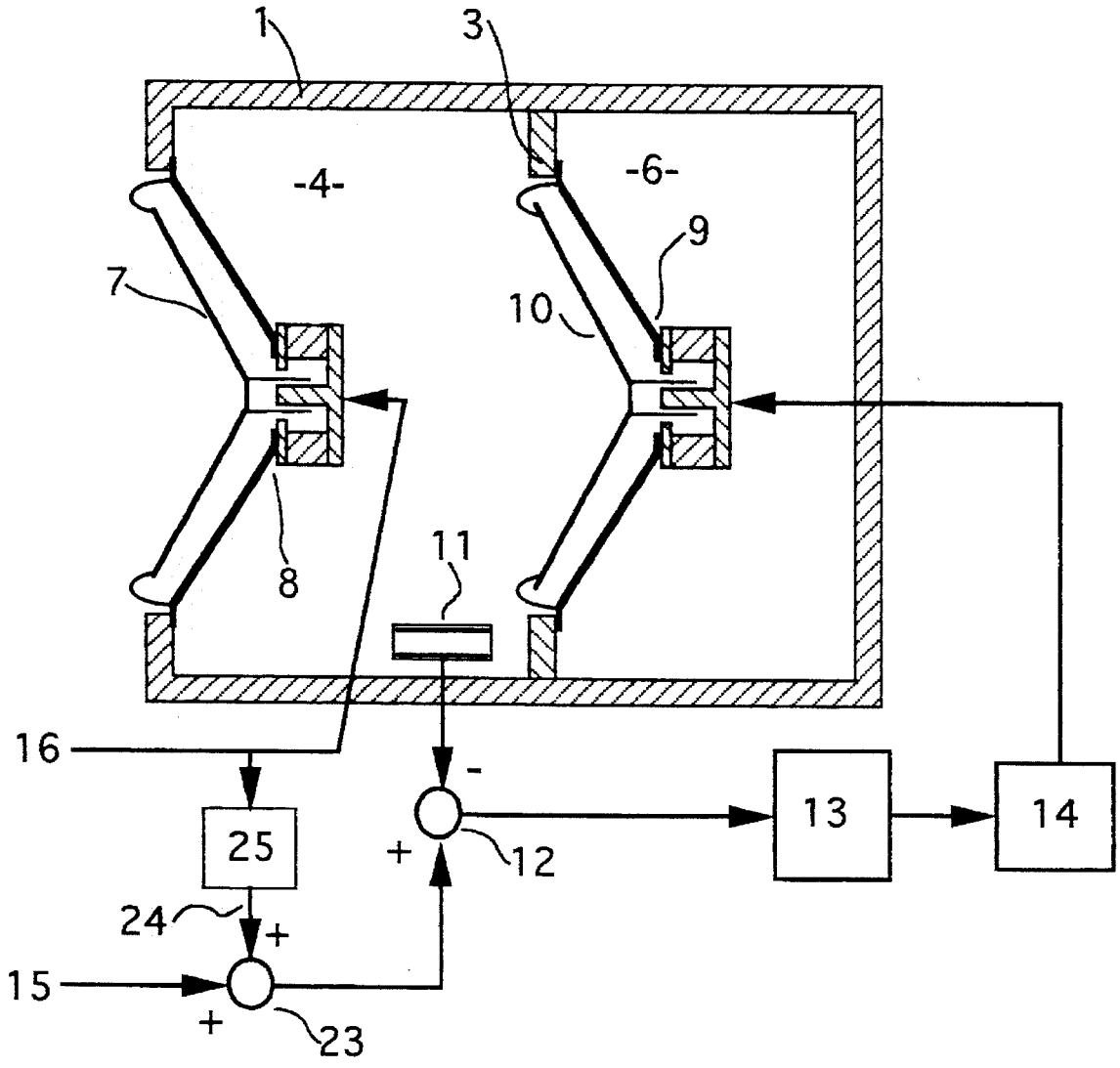
FIG. 5 shows a schematic view of a modified version of the embodiment of FIG. 1.

FIG. 5 shows an embodiment similar to that one of FIG. 1. The only difference is a function block 23 which adds the signal 15 representing the average air pressure with an additional signal 24 which is proportional to the signal 16 driving the loudspeaker. The additional signal 24 is produced by the multiplying block 25 to the input of which the signal 16 is applied. The multiplication factor of this block is chosen that the air pressure in the inner chamber adjoining the sound-radiating loudspeaker is held by the control system to a value which supports the movement of the loudspeaker's membrane. This supporting pressure creates a force upon this membrane which compensates the elastic forces caused by the membrane's suspension at displacement of the membrane. These forces would hinder at low frequencies the movement of the loudspeaker's membrane.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

That which is claimed is:

1. A loudspeaker system with closed housing for improved bass reproduction, comprising:

an acoustically closed housing;

a loudspeaker being so mounted in the housing that its membrane's front faces outward of the housing;

a soundproof and pressure-tight inner wall dividing the inner volume of said acoustically closed housing into a first and a second chambers, whereby the first of said chambers is enclosed by the membrane of said loudspeaker, said inner wall and first parts of the walls of said housing, and the second of said chambers is enclosed by said inner wall and second parts of the walls of said housing;

a closed loop automatic control system, comprising:

an electrodynamic transducer, being built into an opening of said inner wall and separating said first and said second chambers with its membrane;

a pressure sensor, being placed in said first inner chamber which adjoins the membrane of said loudspeaker, for measuring the air pressure in this chamber and producing an electrical signal which is proportional to this pressure;

a power amplifier, the output of said amplifier being connected to said electrodynamic transducer to drive said transducer;

an electrical controller, which is a PI-, PID- or state-space controller, whereby to one input of the controller the signal produced by said pressure sensor is applied, whereby to another input of the controller a signal proportional to the time-averaged mean gas pressure outside the housing is applied as the set point value, the output of said controller being connected to the input of said power amplifier to drive the amplifier, and said controller being dimensioned to keep the pressure in said first inner chamber equal to the mean gas pressure outside the housing by causing said electrodynamic transducer's membrane to move.

2. A loudspeaker system with closed housing for improved bass reproduction, comprising:

an acoustically closed housing;

a loudspeaker being so mounted in said housing that its membrane's front faces outward of said housing;

a first and a second soundproof and pressure-tight inner walls dividing the inner volume of said acoustically closed housing into a first, a second and a third chambers, whereby the first of said chambers is enclosed by the membrane of the loudspeaker, the first of said inner walls and first parts of the walls of the housing, the second of said chambers is enclosed by said first and second inner walls and second parts of the walls of said housing, and the third of said chambers is enclosed by said second inner wall and third parts of the walls of said housing, and whereby the first of said inner walls is equipped with holes which connect the first of said chambers to the second of said chambers, said holes being constructed and stuffed with a fibrous or foamy material with high gas flow resistance, that sound and pressure are transferred between the said first and the said second inner chambers according to a transfer function with low pass characteristics;

a closed loop automatic control system, comprising:

an electrodynamic transducer, being built into an opening of said second inner wall and separating said second and said third chambers with its membrane;

a pressure sensor, being placed in said second chamber, for measuring the air pressure in this second chamber and producing an electrical signal which is proportional to this pressure;

a power amplifier, the output of said amplifier being connected to said electrodynamic transducer to drive said transducer;

an electrical controller, which is a PI-, PID- or state-space controller, whereby to one input of the controller the signal produced by said pressure sensor is applied, whereby to another input of the controller a signal proportional to the time-averaged mean gas pressure outside the housing is applied as the set point value, the output of said controller being connected to the input of said power amplifier to drive the amplifier, and said controller being dimensioned to keep the pressure in said second inner chamber equal to the mean gas pressure outside the housing by causing said electrodynamic transducer's membrane to move.

3. Device for using the principle of pressure control in loudspeaker systems with closed housings, comprising:

a cylindrical, acoustically closed housing, with a fold around the cylinder's body to be used as flange, and with one of the lids, which close the cylinder, being equipped with holes, whereby said holes connect the inside to the outside of the housing, and whereby said holes are so constructed and stuffed with a fibrous or foamy material with high air flow resistance, that sound and pressure are transferred between the inside and the outside of the housing according to a transfer function with low pass characteristics;

a soundproof and pressure-tight inner wall dividing the inner volume of said housing into a first and a second chambers, whereby the first of said chambers adjoins said lid which is equipped with said holes;

a closed loop automatic control system, comprising:

an electrodynamic transducer, being built into an opening of said inner wall and separating said first and said second chambers with its membrane;

a pressure sensor, being placed in said first inner chamber which adjoins said lid with the holes, for measuring the air pressure in this chamber and producing an electrical signal which is proportional to this pressure;

a power amplifier, the output of said amplifier being connected to said electrodynamic transducer to drive said transducer;

an electrical controller, which is a PI-, PID- or state-space controller, whereby to one input of the controller the signal produced by said pressure sensor is applied, whereby to another input of the controller a signal proportional to the time-averaged mean gas pressure outside the housing is applied as the set point value, the output of said controller being connected to the input of said power amplifier to drive the amplifier, and said controller being dimensioned to keep the pressure in said first inner chamber equal to the mean gas pressure outside the housing by causing said electrodynamic transducer's membrane to move.

4. The loudspeaker system of claim 1 or claim 2, wherein said signal which is proportional to the time-averaged mean gas pressure outside the housing is added with an additional signal which is proportional to said input signal of said loudspeaker, wherein the sum of both signals is applied as said setpoint value to said controller's input, whereby said additional signal is produced by multiplication of the input signal of the loudspeaker with a factor, and whereby the value of said multiplication factor is chosen that the air pressure in the chamber adjoining said loudspeaker is held by the control system to a value which supports the movement of the loudspeaker's membrane and creates a force upon this membrane which compensates the elastic forces caused by the membrane's suspension.

5. The loudspeaker system of claim 1 or 2, or the device of claim 3, wherein said pressure sensor consists of a pressure-tight housing equipped with a displaceable lid, whereby said displaceable lid is connected to the housing by a spring which counteracts the displacement, whereby the housing's inner volume is connected to the outside by a narrow hole which ensures a slow pressure transfer between inside and outside, and whereby the displacement of said displaceable lid is measured by distance measuring means and an electrical signal proportional to the displacement is produced.

* * * * *